United States Patent [19]

White

[11] 3,934,877

[45] Jan. 27, 1976

[54] POLICE DEFENSIVE IMPLEMENT

[75] Inventor: Davis L. White, Placida, Fla.

[73] Assignee: Monadnock Lifetime Products, Inc., Fitzwilliam, N.H.

[22] Filed: Dec. 6, 1974

[21] Appl. No.: 530,089

[52] U.S. Cl. ..... 273/84

[51] Int. Cl.[2] ..... F41B 15/02

[58] Field of Search ..... 273/67 R, 68, 70, 72 R, 273/82 R, 84; 272/75, 76

[56] References Cited

UNITED STATES PATENTS

| | | | |
|---|---|---|---|
| 1,568,313 | 1/1926 | Bluhm | 273/82 R |
| 1,817,616 | 8/1931 | Goff | 272/75 |
| 1,986,682 | 1/1935 | Schulz | 273/84 |
| 2,121,989 | 6/1938 | Schnase et al. | 273/84 X |
| 3,231,274 | 1/1966 | Wanders | 273/82 R |
| 3,323,796 | 6/1967 | Carlson | 273/84 X |
| 3,454,274 | 7/1969 | Kaneshiro | 273/84 X |
| 3,608,899 | 9/1971 | Hall | 273/84 |
| 3,703,011 | 11/1972 | Goggi et al. | 273/67 R X |

FOREIGN PATENTS OR APPLICATIONS

| | | | |
|---|---|---|---|
| 1,043,017 | 9/1966 | United Kingdom | 272/75 |
| 1,287,775 | 2/1962 | France | 273/84 |
| 585,446 | 11/1958 | Italy | 273/68 |

OTHER PUBLICATIONS

"Black Belt"; May 1972; p. 29.

"Black Belt"; Mar. 1974; p. 6.

*Primary Examiner*—Richard J. Apley

*Attorney, Agent, or Firm*—Robert T. Gammons

[57] ABSTRACT

This invention relates to a police weapon comprised of two rigid elongate sticks joined at one end by a flexible thong to enable disposing them side by side when the weapon is not being used but to permit whirling one about the other in use and especially to making the sticks of rigid and relatively flexible portions to make the weapon less lethal in use.

4 Claims, 4 Drawing Figures

POLICE DEFENSIVE IMPLEMENT

BACKGROUND OF THE INVENTION

The weapon of this invention is known and used in police work as a Nunchaku and comprises a pair of rigid sticks made, for example, of hard wood or high impact plastic joined at one end by a flexible thong, for example, a leather thong or by a piece of braided rope. When being carried about the sticks are arranged in parallel relation using the thong or cord as a hinge and may be suspended on the belt by means of the connecting cord. In use the device is grasped at the distal end of one of the sticks and the other stick whirled about much as a flail. The device is an excellent defensive weapon, however, it is quite lethal. It is the purpose of this invention to provide a weapon of this kind which will embody the defense advantages afforded by it and at the same time reduce its lethal potential.

SUMMARY OF INVENTION

A police weapon comprising two elongate members, a flexible element connecting an end of one to an end of the other so that the members are free to be disposed side by side or end to end, characterized in that each member comprises a rigid portion and a relatively flexible portion and said flexible element connects the rigid portion of the member to the rigid portion of the other. The members taper from a cross section of predetermined diameter at the ends connected by the flexible element to a cross section of larger diameter at their distal ends. The rigid portions and the flexible portions are of substantially equal length and there is means for removably securing the portions to each other in axial alignment. The rigid portions may be comprised of hard wood or a high impact plastic and the flexible portions of rubber or of a flexible plastic. Optionally, one of the members may be comprised entirely of a rigid material and the other entirely of a flexible rubber-like material.

The invention will now be described in greater detail with reference to the accompanying drawings, wherein.

Figure 2:
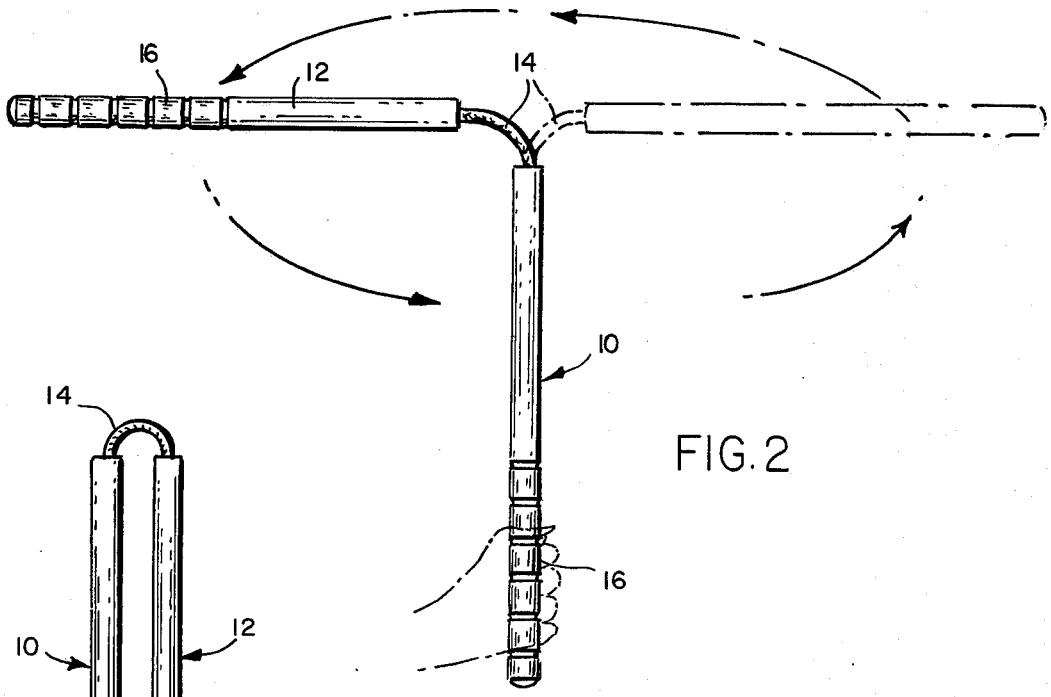
FIG. 2 illustrates a position which might be assumed by one stick when whirled about by the other.
Figure 1:
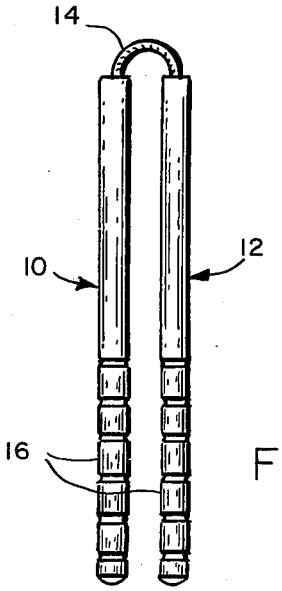
FIG. 1 is a plan view of the implement with the elongate stick-like members disposed side by side as they would be when the implement is carried.
Figure 3:
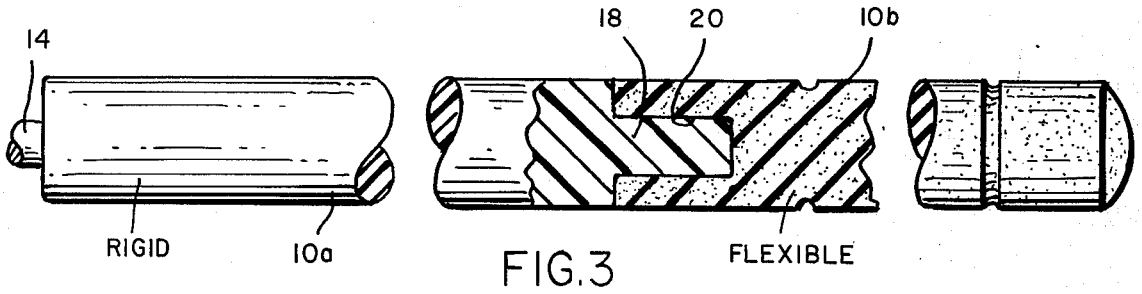
FIG. 3 is a plan view of the single stick showing one way of joining the rigid and flexible portions.
Figure 4:
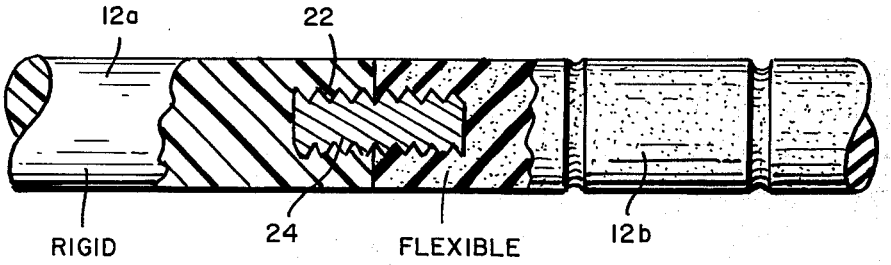
FIG. 4 is a plan view of a single stick showing another way of joining the rigid and flexible portions.

Referring to the drawings, the device comprises two elongate stick-like members 10 and 12 joined at one end by a flexible thong or cord 14. Each stick is tapered from a diameter of predetermined cross section at the end which is connected by the thong 14 to the corresponding end of the other member to a cross section of larger diameter at its distal end and although shown herein as of circular cross section may be of hexagonal cross section or rectangular cross section. Portions 16 of the distal ends of the sticks are provided with knurling or other grooving for a hand grip. In accordance with this invention, to make the implement less lethal each stick is made up of two portions 10*a*,10*b* and 12*a*,12*b*. The portions 10*a* and 12*a* are comprised of a hard wood or a high impact plastic. The portions 10*b* and 12*b* are comprised of a soft or flexible material such as rubber or flexible plastic. The parts 10*b* and 12*b* may be joined to each other in axial alignment as shown in FIG. 3 by a dowel-like extension 18 at the end of the section 10 or 12 and a socket 20 at the adjacent end of the section 10*b* or 12*b* for receiving the dowel. Alternatively, the adjacent ends of the sections 10*b* and 12*b* may contain threaded openings 22 for receiving a threaded coupling element 24.

The proximal ends of the rigid portions 10 and 12 are provided with openings 26 for receiving the thong or cord.

In use the implement is grasped by the handle portion 10*b* or 12*b* of one of the sticks and swung around so as to cause the other stick to be whirled about the distal end of the stick to be held. By reason of the improved construction as described above, the implement can be used for defensive purposes with less danger of permanent injury to the assailant, both because the ends of the stick which constitutes the flail is comprised of a soft or flexible material and because the end grip by means of which the other stick is being held to effect the flailing action is also flexible so that the force of a blow is effectively less.

Optionally, one stick, that is the stick to be held in the hand, may be comprised entirely of a rigid material and the other stick which is to be whirled about comprised of a flexible rubber-like material.

The implement has been described as being made of hard wood or high impact plastic and of rubber or flexible plastic, however, it is to be understood that it is not limited to such materials for any combination of materials which will provide for rigidity in the one part and flexibility or softness in the other part may be used. The degree of softness or flexibility can be chosen, taking into consideration the areas of use and kind of assailants expected to be encountered.

It should be understood that the present disclosure is for the purpose of illustration only and includes all modifications or improvements which fall within the scope of the appended claims.

I claim:

1. A police weapon, comprising two elongate members of equal length each having a portion which is relatively rigid and another portion which is relatively flexible such that the flexible sections will bend relative to the rigid sections, means connecting the members comprising a flexible cord connected at one end to the rigid portion of one of the elongate members and at the other to the rigid portion of the other of the elongate members so that the flexible portion of one of the elongate members constitutes a handle by means of which the implement is wielded and the flexible portion of the other elongate member constitutes an implement for inflicting a blow.

2. A police weapon according to claim 1 wherein there is means for removably securing said portions to each other in axial alignment.

3. A police weapon according to claim 2 wherein said removable means comprises mutually interchangeable threaded portions for removably securing them to each other in axial alignment.

4. A police weapon according to claim 1 wherein the rigid portions are comprised of a high impact plastic and the flexible portions are comprised of rubber.

* * * * *